United States Patent [19]

Hargett

[11] 4,425,858

[45] Jan. 17, 1984

[54] MEANS FOR PROCESSING SHEETS OF MATERIAL

[75] Inventor: Francis B. Hargett, Richmond, Va.

[73] Assignee: AMF Incorporated, White Plains, N.Y.

[21] Appl. No.: 352,628

[22] Filed: Feb. 26, 1982

[51] Int. Cl.[3] ..... D05B 21/00; B65H 39/02

[52] U.S. Cl. ..... 112/121.12; 112/121.15; 278/58

[58] Field of Search ..... 112/121.11, 121.12, 112/121.15, 121.29, 147; 270/58

[56] References Cited

U.S. PATENT DOCUMENTS

| | | | |
|---|---|---|---|
| 2,982,238 | 5/1961 | Fromm | 112/121.11 |
| 3,170,423 | 2/1965 | Henebry | 112/121.12 |
| 3,182,616 | 5/1965 | Cremer | 112/121.12 |
| 3,335,682 | 8/1967 | Tucci | 112/121.15 |
| 3,358,626 | 12/1967 | Bryan | 112/121.12 |
| 3,474,747 | 10/1969 | Noiles | 112/121.12 |
| 3,588,087 | 6/1971 | Rovin et al. | 270/58 |
| 3,620,525 | 11/1971 | Hawley | 270/58 |
| 3,789,781 | 2/1974 | Carson et al. | 112/121.12 |
| 3,796,171 | 3/1974 | Arbter | 112/121.15 |

*Primary Examiner*—Ronald Feldbaum
*Attorney, Agent, or Firm*—David E. Dougherty

[57] ABSTRACT

Method and apparatus for tri-axially aligning, folding, trimming and edge stitching a cloth sheet particularly adapted for making pockets for garments.

10 Claims, 5 Drawing Figures

MEANS FOR PROCESSING SHEETS OF MATERIAL

This invention relates generally to automatic processing of sheets of cloth or fabric material and, more particularly, to inclusion of tri-axial alignment.

Tri-axial alignment in the present application is to be construed to mean alignment accomplished by movement along longitudinal and lateral axes disposed at right angles to one another in the plane of the material and around a vertical axis which is perpendicular to and extends through the plane of the material. The present invention is particularly adapted for making pockets and will be described herein in this manner.

Pockets for garments normally are made of a single piece of cloth or fabric appropriately cut to a particular pattern to which a fascia is sewn to be located at the pocket opening when the pocket is sewn into the garment. After the fascia is suitably attached, the pocket material is appropriately folded and overlying edges are trimmed and sewn forming the actual pocket and leaving only the free edges to be sewn to the garment. Hand folding and manual feeding folded pockets for trimming and stitching is a slow, tedious and costly procedure. To automatically align and feed pocket material to be appropriately folded and thereafter properly trimmed and stitched is difficult to accomplish and up to this time, no automatic equipment to accomplish the foregoing is known.

In accordance with the present invention, an operator stitches a cloth or fabric fascia on to a sheet of cloth or fabric material for making a pocket which is then placed at a starting or feed-in position. At this time precise positioning is not required and can be done by a relatively inexperienced operator who will then initiate the automatic apparatus to complete and stack or accumulate completed pockets. The open pocket is now moved to an alignment position where the material is moved laterally and rotated about a vertical axis until the desired fold line is properly aligned on a longitudinal axis to a position where feed means is capable of delivering the open pocket to folding means. The folding means is provided with means for presenting the folded pocket to a sewing station where the overlapping edges are sensed and accordingly trimmed and stitched together. When completed, means for transferring completed pockets to a stacker or other accumulating means is provided.

The foregoing is a step by step procedure controlled by any suitable programmable controller preferably in response to sensing means as will be described.

Accordingly, an object of the present invention is to provide automatic means including tri-axial alignment for processing sheets of material.

Another object of the present invention is to provide the foregoing automatic means which is a step by step operation after the fascia is sewn by an operator.

Still another object of the present invention is to provide the foreging means having a generally U-shaped flow path with the complete product terminating at a location adjacent the operator.

And another object of the present invention is to provide apparatus particularly adapted for automatically folding, trimming and stitching pockets for garments after unfolded sheets of pocket material are automatically aligned.

And still another object of the present invention is to provide the foregoing apparatus with appropriate sensing means for providing signals to any suitable programmed control for the apparatus.

The foregoing and other objects and advantages will appear more fully hereinafter from a consideration of the detailed description which follows, taken together with the accompanying drawings, wherein a single embodiment of the invention is illustrated by way of example. It is to be expressly understood, however, that the drawings are for illustration purposes only and are not to be construed as defining the limits of the invention.

FIG. 1 is a diagrammatic plan view of the apparatus in accordance with the present invention.

FIGS. 2 and 3 are diagrammatic views taken on lines 2—2 and 3—3, respectively, of FIG. 1 with the robotic or positioning arm in its rotated position in FIG. 2.

At the outset, it should be readily understood that conventional sensors such as photo-optical means, feelers and the like can be used with conventional electromechanical controls, programmed controllers, microprocessors or any other suitable controls for operating the novel apparatus in a desired manner. Although, the present invention is particularly adapted to making pockets for garments, it should be understood that the invention is primarily involved with automatic material processing embodying tri-axial alignment.

Figure 1:
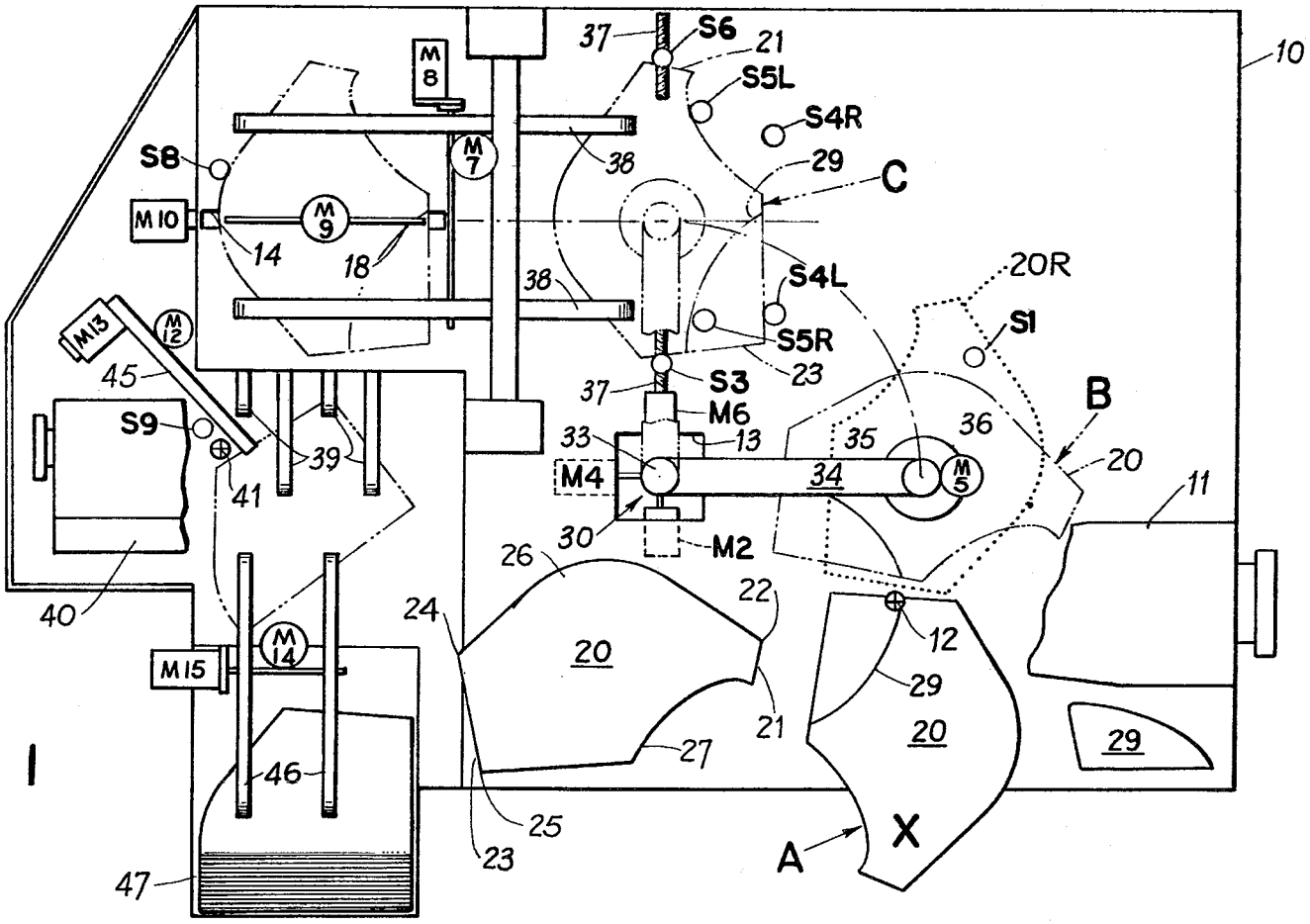
Figure 2:
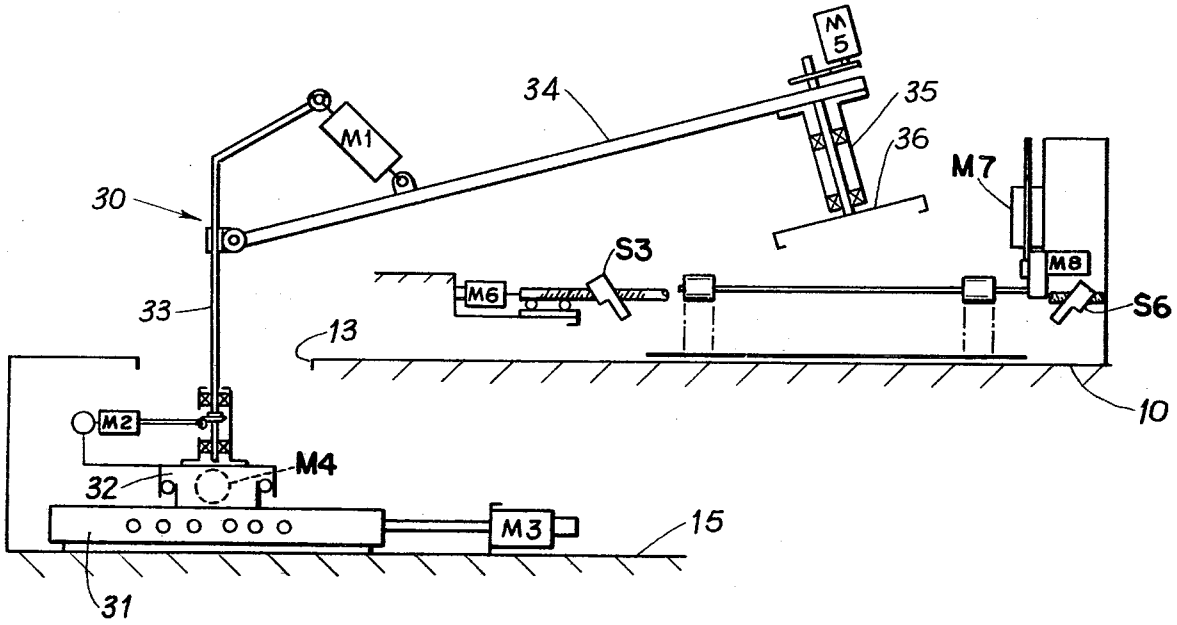
Figure 3:
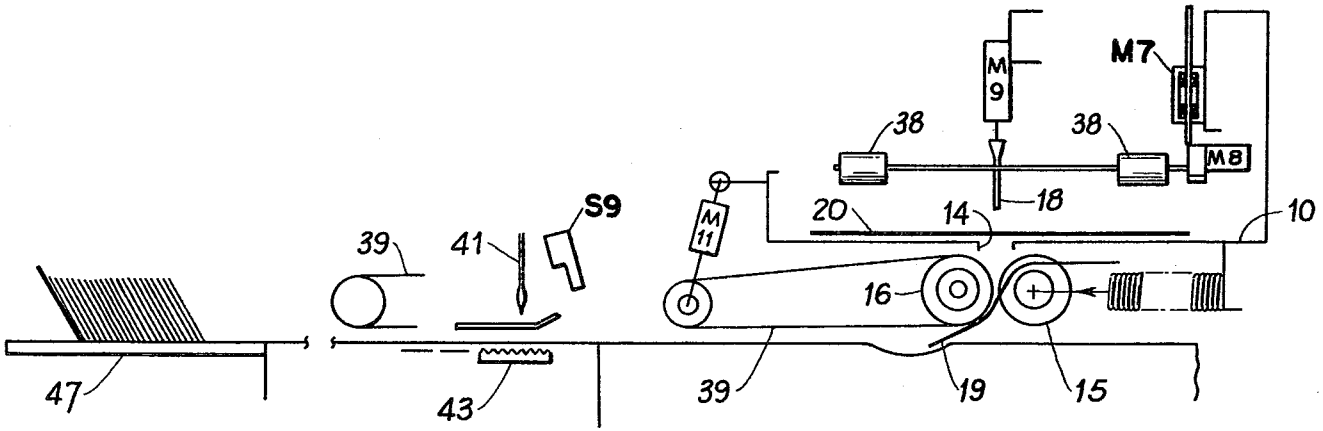
Figure 4:
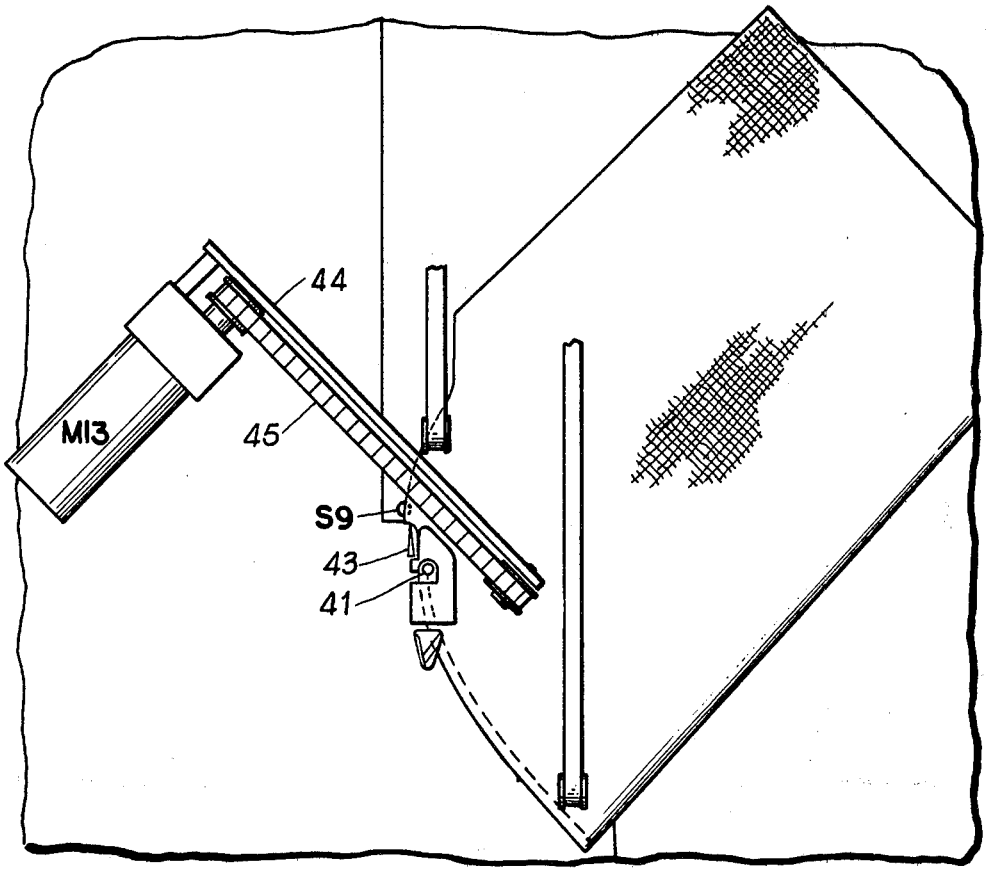
FIG. 4 is an enlarged plan view of the pocket stitching station.
Figure 5:
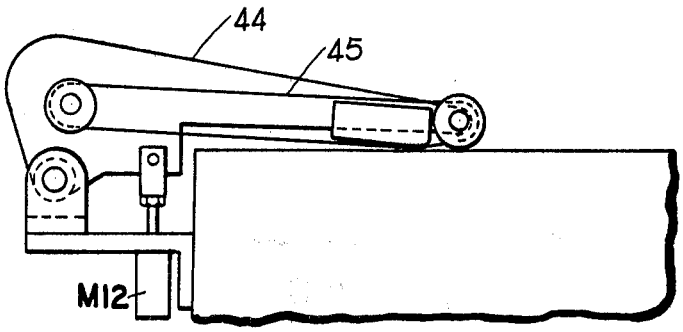
FIG. 5, is a sectional view taken on line 5—5 of FIG. 4.

Referring now to the drawings, an operator is positioned as indicated at X at one side of a layout or upper table 10 and in front of a sewing machine 11 with a reciprocating needle and thread cutting means as indicated at 12. A supply of cloth pockets is provided on one side of the operator while a supply of fascia cloths to be stitched to the pockets are provided on the opposite side. The pockets are cut to a particular pattern which when folded and appropriately trimmed and sewn, will later be sewn into a garment with the fascia at the pocket opening. The pocket as shown in FIG. 1 is cut to a pattern for a left side pocket and by reversing the material, will conform to a right side pocket.

The pocket 70 is provided with opposed linear edges 21 and 23 which when the pocket is properly folded, are aligned with each other particularly where their ends are connected by a leading edge forming corners 22 and 24, respectively, and is the edge that is to be trimmed and sewn. The fascia 29 is sewn at the opposite end or corner 25 formed by the edge 23 and a trailing edge 27 as a manual or operator controlled operation which, when completed, is the beginning of the automatic cycle.

To start, a pocket 20, is manually placed at a position A by the operator who appropriately overlays a fascia 29. The operator then stitches the pocket 20 and a fascia 29 together and at stitch-off and after the threads are cut or at completion, the pocket and fascia are now at position B, and the automatic cycle can now be initiated by the operator such as by actuating a start switch (not shown) or by inactivating the machine 11.

A suitable sensor S1 is provided a position B and is activated when the automatic cycle is initiated to determine whether the cycle is programmed for a right or left hand pocket. When the program sensor S1 is uncovered by a pocket at position B, the apparatus is programmed for a left hand pocket 20, but when the sensor is covered by a pocket, the apparatus is programmed for a right hand pocket 20R.

A robotic arm assembly 30 is provided with a slide or carrier 31, mounted on a lower or finishing table 15 and is driven, as may be required, in a lateral direction by a bidirectional motor M3. Mounted on the carrier 31 is a carrier or slide 32 driven, as may be required, in a longitudinal direction by a bidirectional motor M4. A vertical post 33 is mounted on the carrier 32 for rotation by a bidirectional motor M2 and extends upwardly through an opening 13 in the upper or layout table 10. An arm 34 is pivotally connected at one end to the post 33 and extends outwardly therefrom and in its unoperated position terminates at its other end with a head portion 35 having a cloth engaging disc member 36 which is elevated above position B and is rotatably driven, as may be required, by a bidirectional motor M5. A motor M1 is provided to pivot the arm 34 to lower the head 35 toward the pocket 20 or 20R causing the disc member 36 to engage the cloth or to raise the head 35 after the pocket has been appropriately aligned.

When automatic operation is initiated and sensor S1 has selected the appropriate program, sequentially motor M1 is energized to pivot arm 34 lowering the head 35 until member 36 engages the pocket at which point in time motor M2 causes the robotic arm means 30 to rotate on its axis approximately 90° delivering the pocket 20 along an arcuate path to the alignment of position C. If sensor S1 is covered by a pocket 20R, the apparatus would be programmed for a right hand pocket and as the robotic arm means 30 is rotated by motor M2 from position B to position C, the motor M5 simultaneously would be driving the friction disc 36 counterclockwise 90° to rotate the pocket 20R on the axis of rotation of the friction disc member 36. At position C, the edge 26 to be sewn will always be the leading edge for a left pocket 20 or a right pocket 20R.

Position C is provided with a cluster of edge sensors controlling movement of the robotic arm means 30 for appropriately aligning a pocket. A pair of edge sensors S3 and S6 may be prepositioned, it is preferred that they be mounted to simultaneously move equal distances toward and away from one another by a bidirectional motor M6, to compensate fo differences when the pockets are cut. One means for accomplishing the foregoing is to mount said sensors on slides and to be engaged by opposite ends of a worm gear 37 which is driven by the motor M6. The gears at the ends of worm gear 37 are in opposition to each other so that both sensors S3 and S6 move in unison toward or away from each other depending upon the direction of rotation of the worm gear 37 by the motor M6. The sensors S3 and S6 operate in conjunction with edge sensors S4L and S5L to align a left hand pocket 20, and in conjunction with edge sensors S4R and S5R for a right hand pocket 20R.

The edge sensors at position C and movement of the robotic arm means 30 cooperate to properly align a desired fold line of a pocket 20 or 20R with the nip of a pair of oppositely rotating rollers and for positioning the pocket for delivery to the rollers, which is considered to be the tri-axial alignment earlier alluded to. The upper or layout table 10 is provided with a slot 14 forming a feed-in opening to the nip of a pair of oppositely rotating springs loaded rollers 16 and 17 which form a folder mounted on the lower or finishing table 15 and are driven by a motor M10. A tucking blade 18 is provided above the slot 14 for engaging and urging the desired fold line of a pocket into the nip of the rollers 16 and 17. The tucking blade 18 is parallel to the nip of the rollers 16 and 17, and is operated by a bidirectional motor M9. A feed means comprising a pair of parallel endless belts 38 are lowered to engage an aligned pocket at position C and raised to release a a pocket when appropriately positioned above the rollers 15 and 16.

When the robotic arm means 30 delivers a pocket to position C, motor M3 will move the arm assembly 30 laterally while motor M6 simultaneously adjusts sensors S3 and S6 and motor M5 rotates the pocket on the vertical axis of head 35 to align the desired fold line axially with the nip of rollers 15 and 16. At the same time, motor M4 moves the robotic arm means 30 and, therefore, the pocket longitudinally to position the leading edge of the pocket for engagement by the belts 38. When the edge sensors S3 and S6 with sensors S4L and S5L or S4R and S5R are satisfied, motors M3, M4, M5 and M6 are inactivated. Motor M1 raises the arm 34 and motor M2 returns the robotic arm means 30 to its original position.

Simultaneously, motor M7 lowers the belts 38 which are driven by a motor M8 to move the pocket linearly to a position above the folder or rollers 16 and 17. When the pocket is properly positioned, the leading edge 26 of the pocket is sensed by a sensor S8 which inactivates the motor M8 and activates motor M7 to raise the belts 38. Sequentially, sensor S8 energizes motor M9 to move the tucking or stuffer blade 18 downwardly forcing fold line of the pocket into the nip of rollers 16 and 17. Motor M10 is activated to drive the rollers 16 and 17, and also delivery belts 39 which are dropped to a driving position by a motor M11. The rollers 16 and 17 are provided with guide leaves or springs 19 which direct the folded pocket from the nip of the rollers in the direction of the feed belts 39. It should be noted that the path of travel of a pocket again changes approximately 90° between arriving and leaving the folder formed by rollers 16 and 17.

The belts 39 deliver the pocket, folded edge forward to a sewing machine 40 having a reciprocating needle 41, a feed dog 42 moving the cloth past the needle, an edge trimmer 43 adjacent the needle, and an edge sensor S9. After a timed delay, the sensor S9 in response to the folded edge of the pocket, provides a signal to start the sewing machine 40, cause motor M11 to raise feed belts 39 and de-energize drive motor M10, As the overlying pocket edges move past the sensor S9, they are trimmed by the blade or cutter 43 and are sewn together by action of the reciprocation of the needle 41. The initial signal from sensor S9 in addition to starting the sewing machine 40, energizes motor M12 to lower an arm 44 to bring a belt 45 in contact with the pocket being sewn at a point inboard of and laterally aligned with or slightly trailing the needle 41. The arm 44 and belt 45 are disposed diagonally to the path of travel with the contact point of belt 45 with the pocket forming a pivot center for the edge of the pocket driven by the feed dog 42. A bidirectional motor M13 is provided to drive the belt 45 in response to the pocket edge seen by the sensor S9 to adjust the pivot center created by the contact point of belt 45 for changes in profile of the pocket edge being sewn. As the end of the edge being sewn passes the sensor S9, the response of the sensor S9 after a time delay to complete stitch-off and thread cutting by means (not shown) well known in the art, will inactivate the sewing machine 40 and motor M13 while the motor M12 is energized to raise the arm 44 and belt 45.

Simultaneously, a motor M14 is energized to lower a pair of endless belts 46 which are driven for a timed period by a motor M15 to deliver the completed pocket to a collector 47 such as a bin or stacker adjacent the operators position X.

Although but a single embodiment of the invention has been illustrated and described in detail, it is to be expressly understood that the invention is not limited thereto. Various changes may be made in the design and arrangement of the parts without departing from the spirit and scope of the invention as the same will now be understood by those skilled in the art.

What is claimed is:

1. Apparatus for automatically aligning, folding, trimming and stitching a sheet of fabric material, comprising table means having a starting position and an alignment position with a plurality of sensors for sensing three edges of a sheet of material when appropriately aligned;

a folder mounted on said table means and having a pair of oppositely rotating rollers forming a nip therebetween;

arm means having a contact member for engaging and moving a sheet of material from said starting position to said alignment position and for releasing said sheet of material when aligned;

means for moving said arm means with said sheet of material laterally and longitudinally and for rotating said contact member and said sheet of material for axially aligning a desired fold line of the material with the nip of said rollers;

means for longitudinally moving said aligned sheet of material to said folder and for urging the material at the desired fold line into the nip of said rollers;

means for delivering said sheet of material with the desired fold first to a sewing machine with a reciprocating needle and a feed dog for the edge of said sheet of material being stitched;

blade means adjacent said needle for trimming the edge before stitching;

friction means inboard of said needle engaging and forming a fixed center of said sheet of material while its edge is being stitched;

means for sensing the edge of said sheet of material;

and means for moving said friction means in response to said sensing means for changing the fixed center of said sheet of material according to variations in the profile and said sensed edge.

2. Apparatus in accordance with claim 1, and said arm means comprising a vertical post rotatable on its axis;

an arm pivotally mounted at one end to said post and mounting said contact member at its other end;

a bidirectional motor connected to cause said arm to pivot thereby lowering said contact member to engage a sheet of material and raising said contact member to release a sheet of material; and another bidirectional motor connected to rotate said post thereby moving said contact member between said starting and alignment positions.

3. Apparatus in accordance with claim 2, further comprising a pair of slide means mounted one above the other on said table means;

said post rotatably mounted on the upper one of said slide means;

a pair of bidirectional motors each connected to a different one of said slide means for moving said arm means laterally by one of said motors and longitudinally by the other of said motors; and a bidirectional motor connected to rotatably drive said contact member.

4. Apparatus in accordance with claim 3, further comprising a sensing means at said starting position having a first program condition when covered and a second program condition when uncovered by a sheet of material at said starting position, and said contact member being rotatably driven when a sheet of material is being moved to said alignment position in response to one condition of said sensor.

5. The apparatus in accordance with claim 4, and said friction means comprising a support mounted on said table means extending diagonally to movement of said sheet of material;

an endless belt friction member movably mounted on said support and bidirectional motor means for driving said friction member; and means for raising and lowering said support thereby moving said friction member into and out of contact with a sheet of material being sewn.

6. The apparatus in accordance with claim 5, and another sewing machine for stitching a fascia to one corner of said sheet of material which after sew-off when the threads are cut is at said starting position.

7. The apparatus in accordance with claim 6, and providing a generally U-shaped path of movement of a sheet of material extending from other sewing machine to the sewing machine sewing the edge of said sheet of material.

8. A method of automatically aligning and folding a fabric sheet, and trimming and stitching one edge of the sheet at the end of the fold, comprising the steps of providing table means, and a folder mounted on said table means and having a pair of oppositely rotating rollers with a nip therebetween;

moving a fabric sheet to an alignment position on said table means and providing means for sensing three edges of said sheet when a desired fold line of said sheet is axially aligned with the nip of said rollers;

simultaneously moving said sheet laterally and rotatably on a vertical axis to axially align the desired fold line with the nip of the rollers while moving the sheet longitudinally to permit contact of the sheet by delivering means;

moving said fabric sheet longitudinally to said folder and urging the fold line into the nip of the rollers;

delivering said folded fabric sheet fold first to a sewing machine having a reciprocating needle and feed dog for edge stitching and trimming the edge prior to stitching;

providing friction means engaging said fabric sheet inboard of said needle forming a pivot point for the fabric sheet during stitching;

and means sensing the edge before trimming, and moving said friction means to adjust the pivot point of said fabric sheet in response to sensed changes of said edge profile.

9. The method in accordance with claim 8, and rotating said fabric sheet substantially on a vertical axis as said sheet is being moved to said alignment position.

10. The method in accordance with claim 9, and moving said fabric sheet along a substantially U-shaped path starting in front of an operator's station and terminating substantially adjacent such station.

* * * * *